US007784238B2

(12) United States Patent
Bannister

(10) Patent No.: US 7,784,238 B2
(45) Date of Patent: Aug. 31, 2010

(54) VARIABLE HEIGHT INTERLOCKING MOULDING STRIP FOR FLOORING

(76) Inventor: Toni P. Bannister, 1035 Victoria Ave., Burlington, WA (US) 98233

( * ) Notice: Subject to any disclaimer, the term of this patent is extended or adjusted under 35 U.S.C. 154(b) by 967 days.

(21) Appl. No.: 11/406,649

(22) Filed: Apr. 19, 2006

(65) Prior Publication Data

US 2006/0272269 A1 Dec. 7, 2006

Related U.S. Application Data

(60) Provisional application No. 60/673,041, filed on Apr. 19, 2005.

(51) Int. Cl.
*E04C 3/00* (2006.01)

(52) U.S. Cl. ..... 52/465; 52/278; 52/459; 52/463; 52/287.1

(58) Field of Classification Search ..... 52/278, 52/208, 36.1, 459, 465, 463, 98, 287.1, 716.4
See application file for complete search history.

(56) References Cited

U.S. PATENT DOCUMENTS 3,303,626 A * 2/1967 Brigham ..... 52/717.05
3,570,205 A * 3/1971 Payne ..... 52/466
3,667,177 A * 6/1972 Biela ..... 52/278
3,760,544 A * 9/1973 Hawes et al. ..... 52/468
3,878,660 A * 4/1975 Jacob ..... 52/573.1
4,067,155 A 1/1978 Ruff et al.
4,165,119 A * 8/1979 Hedeen et al. ..... 296/93
4,434,593 A * 3/1984 Horike et al. ..... 52/208
4,438,609 A * 3/1984 Nielson et al. ..... 52/208
4,653,138 A * 3/1987 Carder ..... 16/4
4,712,826 A * 12/1987 Omori ..... 296/93
4,986,594 A * 1/1991 Gold et al. ..... 296/201
5,155,952 A 10/1992 Herwegh et al.
5,396,746 A * 3/1995 Whitmer ..... 52/208
5,678,380 A * 10/1997 Azzar ..... 52/716.4
6,345,480 B1 2/2002 Kemper et al.
6,729,092 B2 5/2004 Grosjean

OTHER PUBLICATIONS

Johnsonite Products: Contour Edge Transition.
Floorshop: All about transitional moldings.

* cited by examiner

*Primary Examiner*—Basil Katcheves
(74) *Attorney, Agent, or Firm*—Todd N. Hathaway

(57) ABSTRACT

An adjustable height transition moulding and method for use thereof. The moulding is installed at the transition between adjoining floor coverings/surfaces, such as between carpet and laminate floor coverings. The moulding includes a contoured cap and a depending wall portion having a series of vertically spaced rib portions along its lower edge that snap into the channel of a base track that is mounted to the subfloor. The installed height of the moulding is adjusted by removing a selected number of the rib portions. The rib portions are spaced apart by slots and joined by relatively thin, vertically extending web portions. A knife or other blade is inserted through one of the slots to make an initial cut in the selected web portion, and the remainder of the web portion is then torn by pulling on the lower rib portions so as to peel them away over the full length of the moulding strip. The moulding is simply formed of extrusion molded flexible PVC.

4 Claims, 6 Drawing Sheets

VARIABLE HEIGHT INTERLOCKING MOULDING STRIP FOR FLOORING

RELATED CASES

This application claims the benefit of U.S. Provisional Patent Application Ser. No. 60/673,041 filed Apr. 19, 2005.

BACKGROUND a. Field of the Invention

The present invention relates generally to floor mouldings, and, more particularly, to a moulding strip which has an interlocking construction and which is adjustable in height so that it can be used along the edges having floor coverings of different thicknesses/heights.

b. Background

Elongate transition mouldings are commonly installed along the edges of floor surfaces where there is a transition to another type of floor covering or to an area in which the subfloor is exposed. For example, such mouldings are commonly installed between carpet and laminate/linoleum/tile floor coverings, and at transitions where a covered floor surface ends and drops down to an area in which the underlying concrete or wood subfloor is exposed. Oftentimes, the edge is curved, so that the moulding must be flexible in order to follow the contours of the transition.

One such type of moulding (e.g., snap-in, track-base mouldings available from Johnsonite, Chagrin Falls, Ohio) uses a two-piece interlocking construction in which there is a base member forming a channel which is mounted to the subfloor, and a cap strip having a depending wall portion which is received in the channel. After the carpet or other floor surface material has been laid over the base strip, the lower edge of the cap strip is pressed into the channel to lock the two members together.

A particular deficiency which is exhibited by conventional mouldings of this type is that the assembly defines a fixed vertical height between the subfloor and cap for any given size of moulding. This is a serious drawback, because floor coverings of different thicknesses are often installed in various areas of the same structure. For example, the height of the flooring surface may only be ¼" above the subfloor in some areas, and in other areas (such as along the edges of tiled surfaces) the height of the floor surface may be ½" or more above that of the subfloor.

Consequently, since no single size of the conventional interlocking moulding material can accommodate these variations in height, it is necessary for the installer to have two or more different sizes of the material constantly available, at added cost and inconvenience. Moreover, the need to provide several different heights of cap strips adds significantly to the manufacturer's and supplier's costs.

Some attempt has been made to address this problem by providing an auxiliary channel strip which mounts within the first so as to raise the overall height of the assembly. However, since this requires the installer to buy and assemble yet another piece of material, and because each size of "add-on" channel has its own fixed height, this does little or nothing to alleviate the problems of cost and inefficiency which are inherent in the conventional product.

Accordingly, there exists a need for a transition moulding in which a single size of moulding can be utilized in installations requiring different heights according to the thicknesses of the adjoining floor coverings. Furthermore, there exists a need for such a transition moulding that can be used in conjunction with standardized mounting hardware that is readily available on the market. Still further, there exists a need for such a transition moulding that can be installed quickly and without requiring the use of specialized tools. Still further, there exists a need for such a moulding that is sufficiently flexible to allow installation along curved contours, but which is sufficiently stable once installed to avoid undesirable shifting or displacement underfoot during use. Still further, there exists a need for such a transition moulding that is durable and presents an attractive appearance, and which is also economical to manufacture.

SUMMARY OF THE INVENTION

The present invention has solved the problems cited above, and is an adjustable height transition moulding and method for use thereof.

Broadly, the transition moulding of the present invention comprises: (a) an elongate cap portion having first and second laterally-extending flange portions; (b) an elongate, relatively thick depending wall portion that extends downwardly from the cap portion beneath a junction between the first and second flange portions; (c) a plurality of vertically-spaced detachable rib portions that are mounted to a lower edge of the wall portion for being received in locking engagement with a channel portion of a base track when the transition moulding is installed therein; and (d) a plurality of relatively thin web portions that interconnect the vertically-spaced rib portions, the web portions being severable so that an installed height of the transition moulding is selectively adjustable by cutting one of the web portions and removing a predetermined number of the rib portions before installing the moulding in the base track.

The transition moulding may further comprise a non-detachable rib portion that is mounted to the lower edge of the depending wall portion above the detachable rib portions, for being received in the channel portion of the base track when the uppermost of the detachable rib portions has been removed.

Each of the detachable rib portions may comprise first and second ridges that extend laterally from the web portions. The first and second ridges may comprise upwardly and outwardly sloped upper and lower walls, so that each of the rib portions has a downwardly pointed arrowhead configuration. Each of the ribs may further comprise a generally vertical edge wall that extends generally parallel to the web portions. The upper, non-detachable rib portion may comprise first and second laterally extending ridges having upwardly and outwardly sloped lower walls, and flat, substantially horizontal upper walls that extend outwardly from the relatively thick depending wall portion of the moulding. The lower and upper walls may meet to form first and second pointed side edges of the non-detachable rib member.

The detachable rib portions may be spaced apart by laterally extending slots that provide access therethrough for a blade to sever the web portions. The web portions may have a thickness sufficiently thin to allow each web portion to be torn manually by pulling on a lower rib portion once an initial cut has been made at an end of the web portion.

The transition moulding may be formed unitarily of extruded plastic material. The extruded plastic material may be extruded, resiliently flexible PVC material. The cap portion of the transition moulding may have a contour that is selected to cooperate with floor coverings of predetermined heights on first and second sides thereof. The transition moulding may further comprise a decorative pattern formed on an upper surface of the cap portion.

The present invention further provides a method for varying the installed height of a transition moulding, comprising the steps of (a) providing a transition moulding comprising: a cap portion having first and second transversely extending flange portions, a relatively thick depending wall portion that extends downwardly from the cap portion from a junction between the flange portions, and a plurality of vertically spaced rib portions mounted to a lower edge of the depending wall portion for being received in a channel portion of a base track in locking engagement therewith; (b) removing a predetermined number of the rib portions from the depending wall portion of the transition moulding; and (c) installing the transition moulding by pressing the lowermost remaining rib portion into the channel portion of the base track, so that the installed transition moulding has a height above the base track that is varied by the number of rib portions that have been removed.

The step of removing a predetermined number of rib portions may comprise removing zero rib potions from the transition moulding, so that the transition moulding has a full height when installed in the base track. The step of removing a predetermined number of rib portions may comprise removing one or more of the rib portions from the transition moulding, so that the transition moulding has a reduced height when installed in the base track.

The step of removing the rib portions may comprise severing a relatively thin web portion that interconnects and separates the spaced apart rib portions. The step of severing the relatively thin web portion may comprise the steps of forming an initial cut at an end of the web portion, and pulling on the distal rib portion so as to manually tear the web portion beginning at the initial cut.

The step of forming the initial cut in the web portion may comprise inserting a blade through a slot that separates the vertically spaced web portions so as to provide access to the relatively thin web portion.

These and other features and advantages of the present invention will be more fully understood from a reading of the following detailed description with reference to the accompanying drawings.

DETAILED DESCRIPTION

The present invention is an interlocking transition moulding in which the depending mounting wall of the moulding has a plurality of vertically spaced rib portions along its lower edge, each of which is configured to fit within and engage a base channel that is mounted to the floor, and which are configured to be selectively removable so as to permit the height of the moulding to be adjusted as necessary to match that of the floor covering with which the moulding is being used. As used herein, the terms upper, lower, vertical, horizontal, and so on reference the orientation of transition moulding when installed in a base track on a normal, horizontally extending floor.

Figure 1:
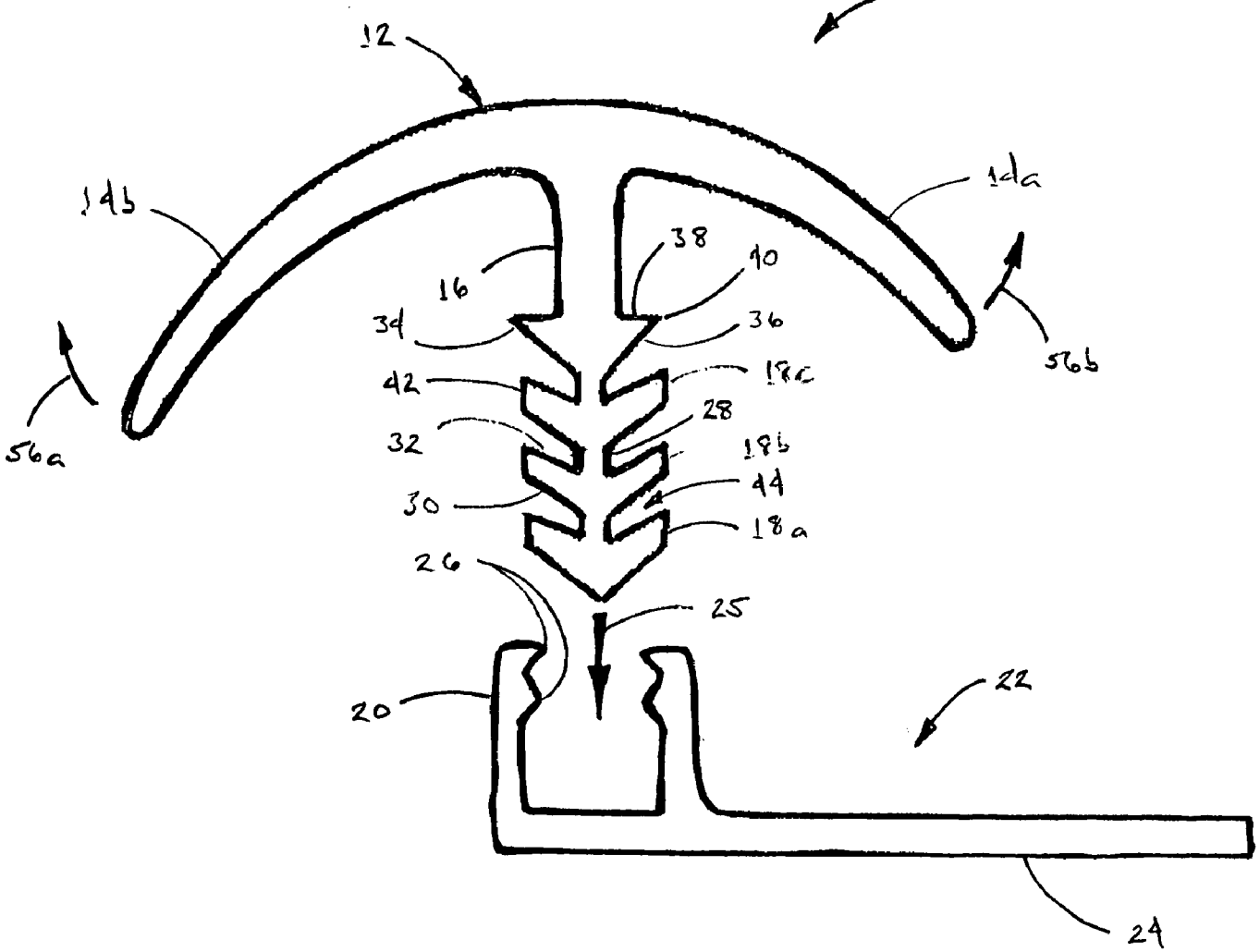
FIG. 1 is an end, cross-sectional view of a multi-height transition moulding in accordance with the present invention, showing the manner in which this is inserted into an exemplary mounting track.
Figure 2:
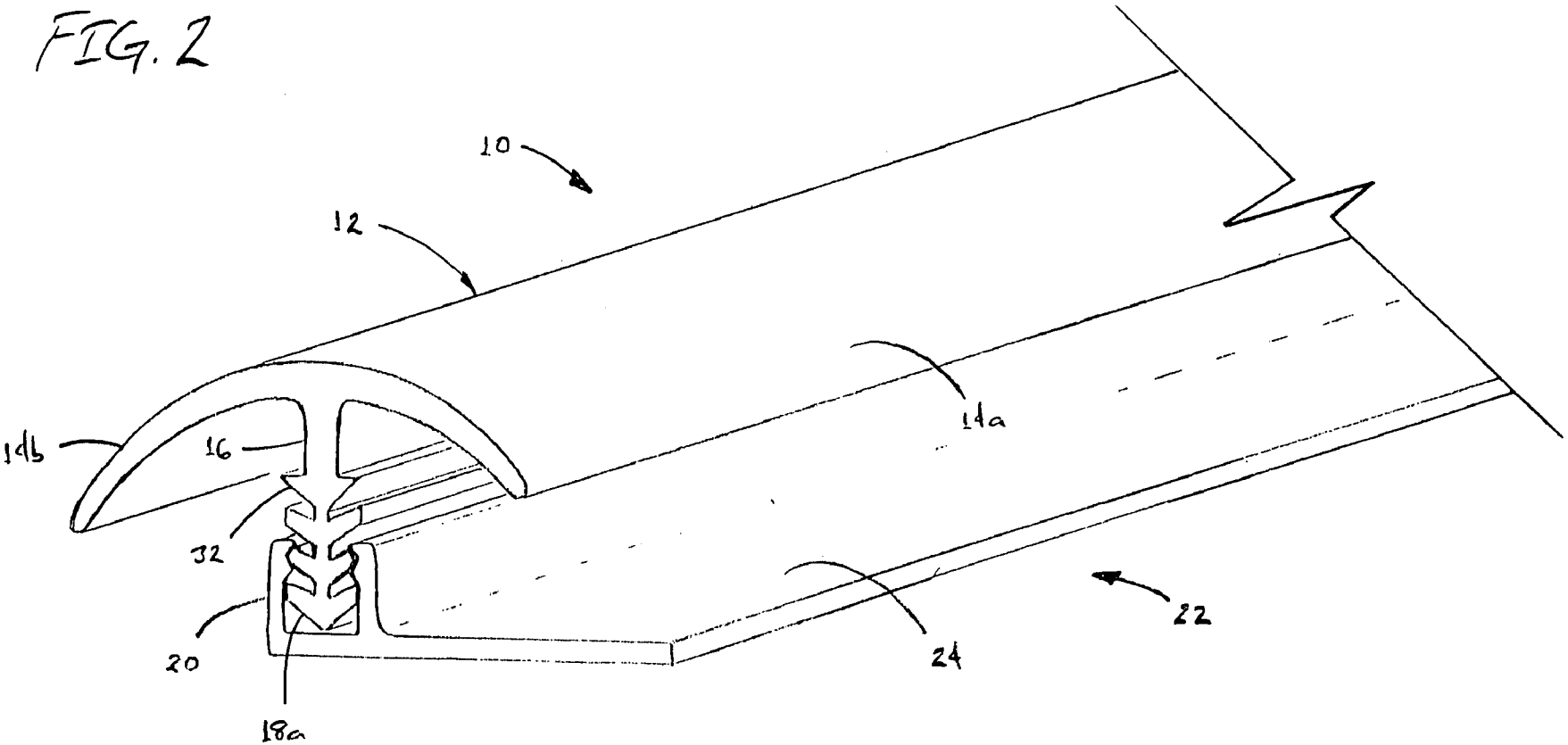
FIG. 2 is a perspective view of the transition moulding and mounting track of FIG. 1, showing the manner in which these are joined so as to form an elongate trim assembly that extends between adjoining flooring surfaces.

As can be seen in FIG. 1, a moulding strip 10 in accordance with the present invention includes a cap portion 12 having first and second flange portions 14*a*, 14*b* which extend outwardly therefrom for covering the edges of the adjacent floor coverings. The depending wall portion 16, in turn, is provided with a series of vertically-spaced, downwardly-pointed detachable rib portions 18*a*, 18*b*, 18*c* along its lower edge, which are configured to be received in and engage the generally U-shaped channel portion 20 of the base track 22 when inserted therein, as indicated by arrow 25. The base track 22 is suitably of a conventional configuration, and includes a flange portion 24 for mounting to the underlying floor surface and a plurality of retaining ridges or ribs 28 formed along the sidewalls of the track portion; in some instances, the flange portion 24 may be slotted or notched to ease bending to follow a curved contour.

As can be seen with further reference to FIG. 1, the detachable rib portions 18*a-c* are spaced apart by vertically extending web portions 28 that are thinner than the main wall portion 16 and therefore have a somewhat reduced strength. Each of the rib portions has a generally arrowhead-shaped configuration and includes a pair of upwardly and outwardly sloped lower walls 30 which define a downwardly tapering portion, and a pair of sloped upper walls 32 which define the top of the rib. As can be seen, the upper walls preferably slope at a somewhat shallower angle than the lower walls 30, so that the ribs are relatively thinner and more flexible at their tips/edges for ease of insertion and adaptability to slight variations between types of track, and relatively thicker and more rigid at their bases for greater stability and resistance to transverse forces when installed.

A final, non-detachable rib portion 34 is formed above the detachable rib portions 18*a-c*. As can be seen, the non-detachable rib also includes lower walls 36 that slope downwardly towards a point, although these are preferably somewhat more steeply angled than the lower walls of the detachable rib portions. The upper walls 38 of the non-detachable rib portion are, in turn, substantially horizontal (i.e., they preferable extend in a substantial horizontal direction when the moulding is installed), and meet the sloped lower walls 36 at pointed tips/edges 40, as opposed to the flat, vertically-extending edges 42 of the detachable rib portions 18*a-c*. The width of the upper walls 38, between the relatively thicker depending wall portion 16 and the tips/edges 40, is therefore relatively narrower than that of the upper walls 32 of the detachable rib portions, and the body of the non-detachable rib portion is also relatively thicker. This serves to form a strong, stable non-detachable connection between the main wall portion 16 and the upper-most rib 34, while still allowing the upper-most rib to be "snapped" into the retaining track when desired: When pressed into the retaining channel, the wing-shaped ridges of the detachable ribs flex upwardly into the notches 34 that separate the ribs, while the case of the upper, non-detachable rib portion the thinness of the material at the pointed edges 40 enable these areas to bend/deform upwardly when entering the channel.

The plurality of detachable ribs 18*a-c* are interconnected in vertical alignment by the central web portion 28, which is a downward extension of the depending wall portion 16. As noted above, the detachable ribs are spaced apart by a series of notches 44, at which the central web 28 is accessible in the lateral direction.

Figure 3:
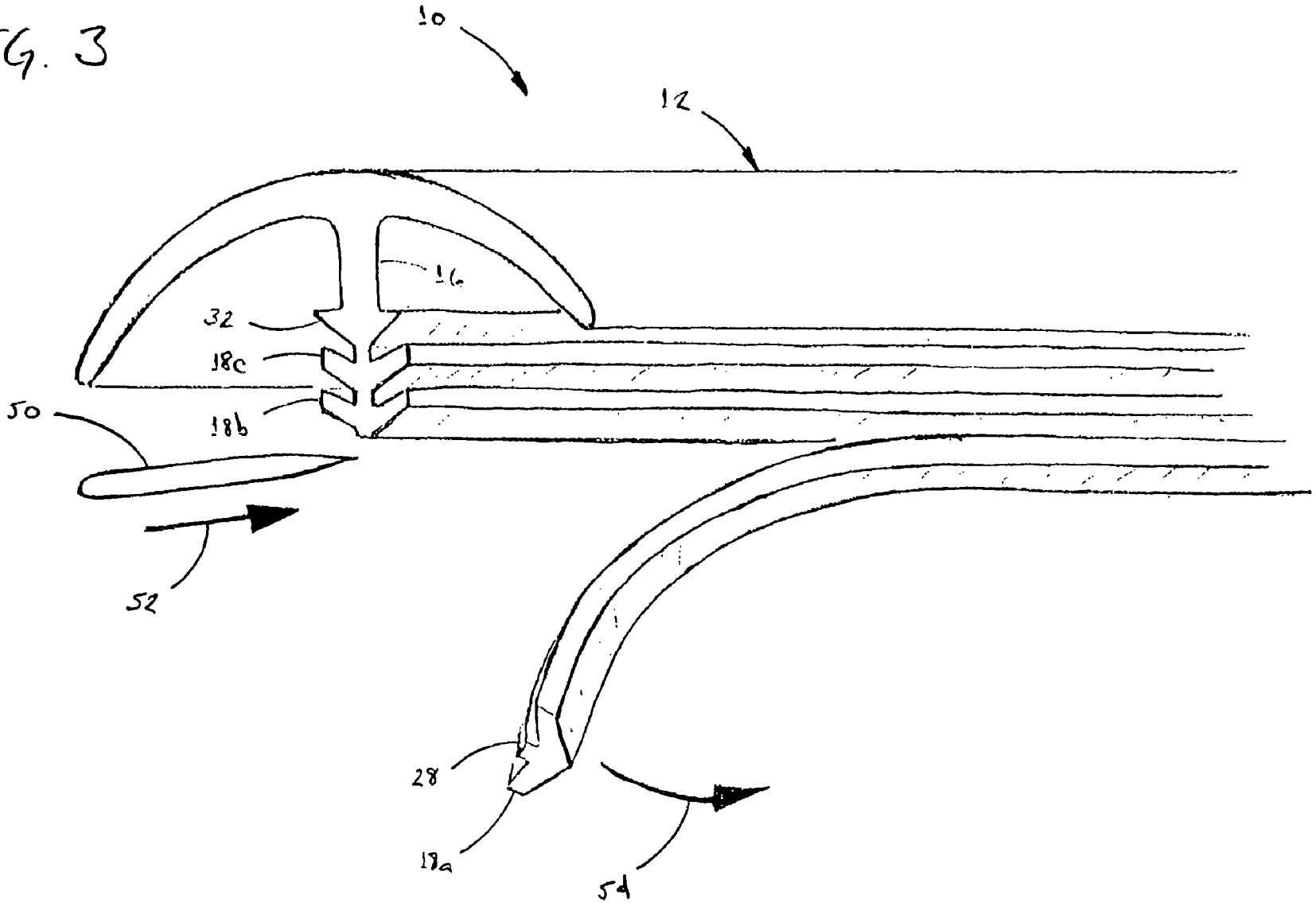
FIG. 3 is an enlarged, perspective view of the transition moulding of FIGS. 1-2, showing the manner in which the height of the moulding is adjusted by cutting and then peeling away one or more selected rib portions from the depending wall portion of the moulding.

The height adjustments are made by selectively removing one or more of the rib portions 18*a-c*. The notches 44 are sized (approximately 1/16"-3/32" in height) to receive the cutting edge of a typical utility knife 50, which is commonly about 1/32" wide. The upper walls 32 of each rib portion provide flat guide surfaces for directing the knife (or a razor blade or other blade) along a straight line as it makes its cut, as indicated by arrow 52 in FIG. 3. After the initial cut has been made at one end of the moulding, the operator grasps the end of the severed rib or ribs in one hand and pulls downwardly and away, in the direction indicated by arrow 54, while holding the remainder of the moulding in the other hand. As this is done, the web 28 tears apart, starting at the cut, so that the selected rib or ribs are readily peeled away over the full length of the moulding strip. The webs have a thickness selected relative to the strength (tear resistance) of the material to provide a reduced strength that enables them to be torn easily once the initial cut has been made, e.g., 1/16 inch when using 80-90 durometer extrusion molded PVC in the illustrated embodiment. The selected rib or ribs can therefore be removed very rapidly and conveniently; at the same time a straight lower edge is left at the bottom of the lower-most remaining rib, eliminating the potential for unevenness or undulations when the moulding is installed in the track.

Figure 4H:
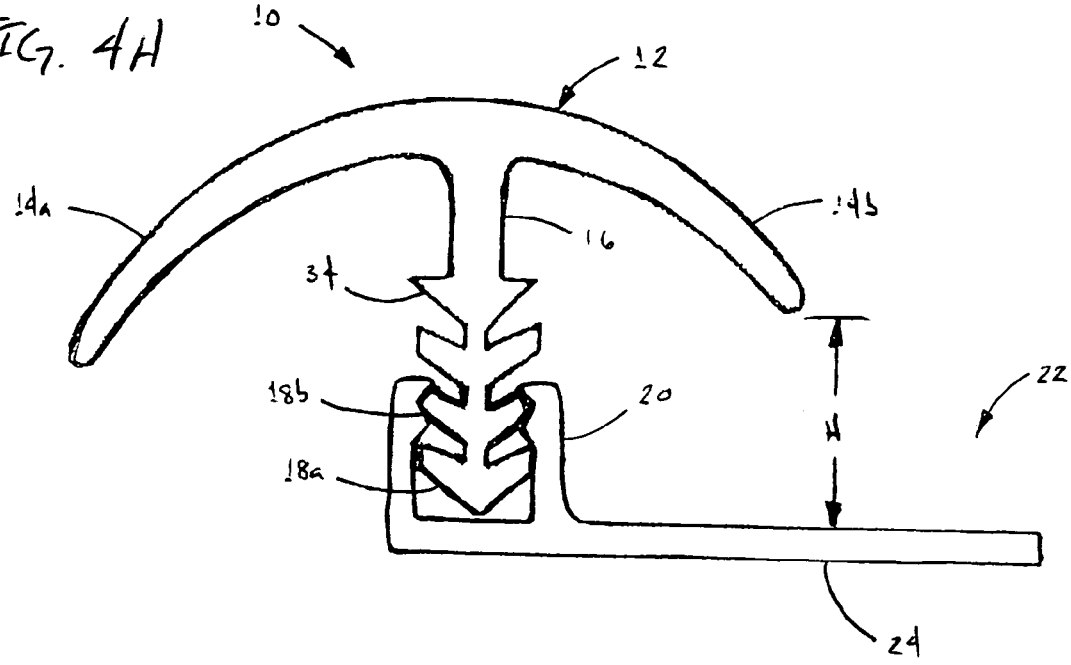
FIGS. 4A and 4B are first and second end, cross-sectional views of the transition moulding and mounting strip of FIGS. 1-2, showing the manner in which the installed height of the moulding varies depending on the number of locking ribs that are removed from the depending mounting portion of the moulding.
Figure 4B:
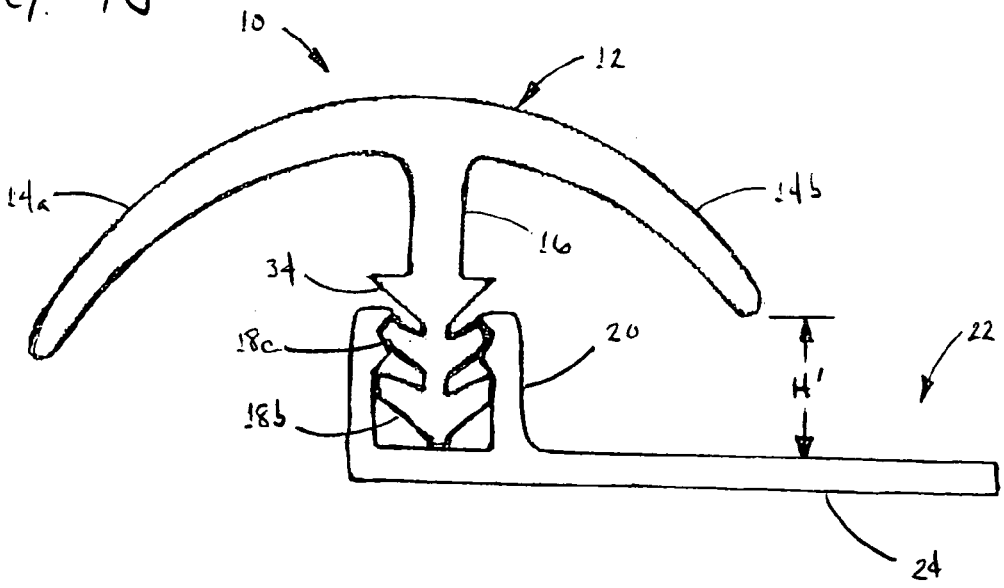
Figure 5:
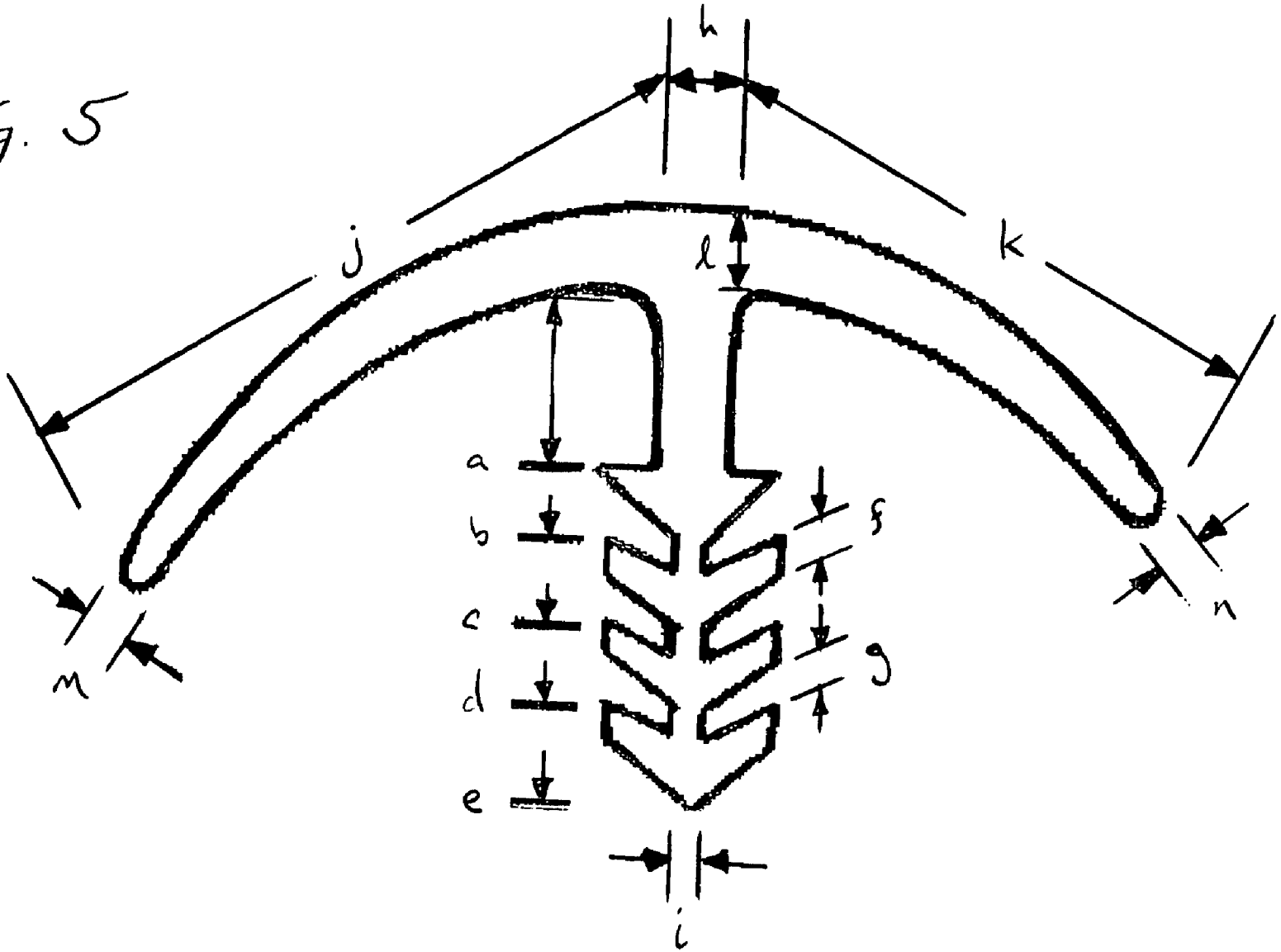
FIG. 5 is an enlarged end, cross-sectional view of the transition moulding of FIGS. 1-4, showing the configuration and dimensions of the locking ribs of the depending mounting portion of the moulding in greater detail.

Thus, as is shown in FIGS. 4A-4B, the height of the strip is easily adjusted to meet the requirements of different installations. In order to begin to the installation, the base channel 22 is first mounted with its flange portion 24 extending horizontally against the subfloor, and its channel portion 20 extending upwardly in a vertical direction. The moulding strip 10 is trimmed to the desired height by removing the corresponding number of ribs from the lower edge of the depending wall portion as described above, and the lower-most remaining rib is then inserted vertically into the channel portion of the track as shown in FIG. 1. The lowermost remaining rib penetrates to the bottom of the channel and is locked in place by the inwardly projecting ribs 26.

Consequently, the height of the cap and its flanges above the subfloor varies according to the number of rib portions that have been removed. For example, as can be seen in FIG. 4A, the moulding is at its full height "H" when none of the rib portions have been removed (i.e., the number of ribs removed is "zero"), so that the bottommost rib portion 18*a* is received in the channel 20. By contrast, as can be seen in FIG. 4B, the cap portion is located at a reduced height "H'" (e.g., 3/32 inch lower) when the bottom rib portion has been removed and the second lowest rib portion 18*b* is at the bottom of the channel. It will also be seen in FIGS. 4A-4B that the next higher rib portion (18*b* in FIG. 4A, and 18*c* in FIG. 4B) is received and compressed in a somewhat upwardly flexed configuration between the upper ridges or ribbing of the channel portion, thus increasing the stability and security of the installation and helping to minimize any potential for accidental dislodgement of the moulding. In the majority of installations, the height of the strip is preferably selected so that the flange portions 14*a*, 14*b* are held firmly in place and are flexed resiliently in an upward direction, as indicated by arrows 56*a*, 56*b* in FIG. 1, so as to exert a downwardly-biased pressure against the adjacent floor surfaces.

Although the number and size of the rib portions and other features may vary depending on design factors, the preferred embodiment that is shown in FIGS. 1-5 represent a particularly versatile configuration that is suitable for use with a wide range of floor coverings. This configuration includes three detachable and one non-detachable rib members, providing incremented adjustments of about 3/32 inch. These and other dimensions for the exemplary embodiment are given in the following Table A:

TABLE A

| | | |
|---|---|---|
| a | Height of depending wall portion (to top wall of upper rib) | 7/32 inch |
| b | Height of upper rib | 3/32 inch |
| c | Height of second rib | 3/32 inch |
| d | Height of third rib | 3/32 inch |
| e | Height of bottom rib | 3/32 inch |
| f | Height of lower rib and walls | 3/64 inch |
| g | Height of lower rib slots | 3/64 inch |
| h | Transverse width of depending wall portion | 1/8 inch |
| i | Width of interconnecting wall portion between ribs | 1/16 inch |
| j | Lateral width of first cap flange | +11 7/8 inch |
| k | Lateral width of second cap flange | 5/8 inch |
| l | Vertical thickness of cap flange in conjunction with depending wall portion | 1/8 inch |
| m | Thickness of cap flange at first edge | 3/32 inch |
| n | Thickness of cap flange at second edge | 3/32 inch |

It will be understood that the foregoing dimensions are only an example of one preferred embodiment of the invention, and other sizes, spacings and numbers of rib portions may be used as desired.

Figure 6A:
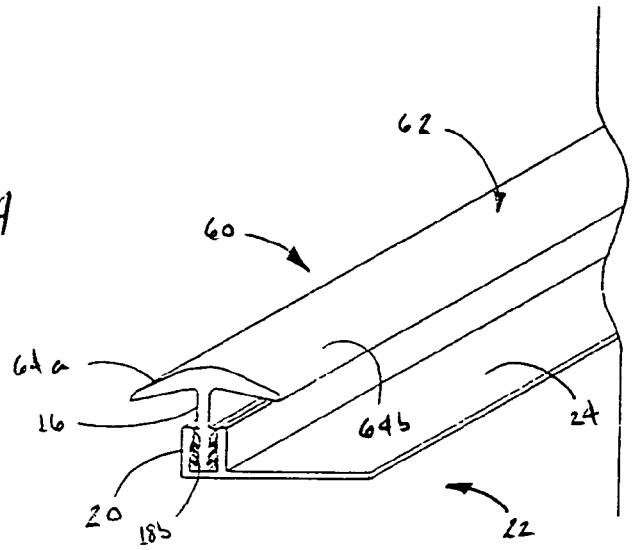
FIGS. 6A-6C are perspective views of additional transition mouldings and locking strips, illustrating additional cap configurations with which the transition mouldings of the present invention can be provided.
Figure 6B:
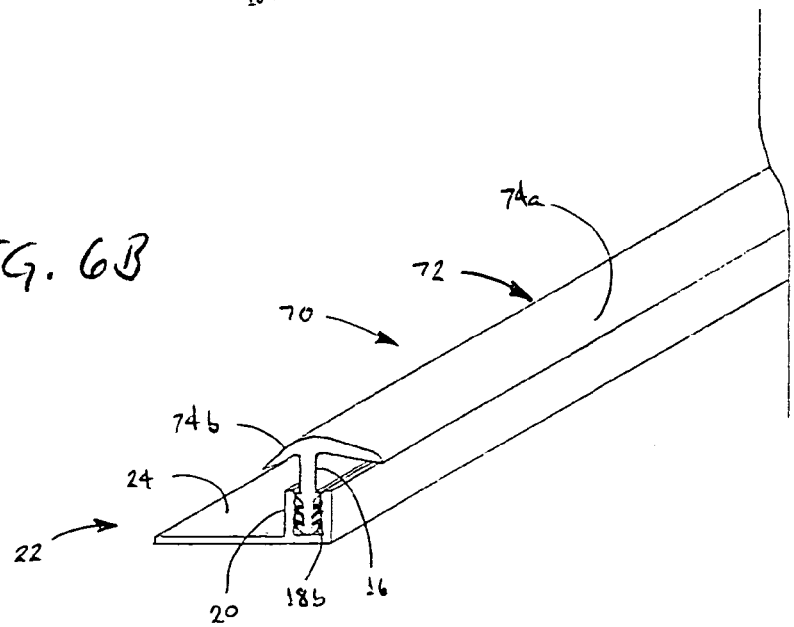
Figure 6C:
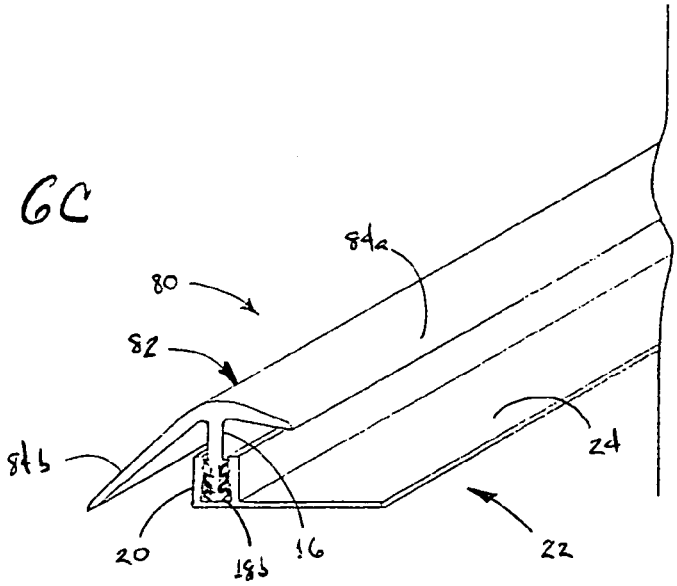

The configuration of the cap portion 12, in turn, that is shown in FIGS. 1-5 is particularly suited to use at transitions between carpeted and laminate floor surfaces. FIGS. 6A-6C show embodiments of the present invention in which the structure is substantially similar to that described above, except that the configurations of the flange portions of the cap strips are somewhat different, and therefore in which like reference numerals will refer to like elements of the moulding.

In particular, FIG. 6A shows a moulding strip 60 having a cap portion 62 with somewhat narrower (e.g., 5/16 inch) flange portions 64A, 64*b* that extend at relatively shallow angles. This profile is less highly arched than the cap portion 12 of the embodiment described above; moreover, in most installations, there is less flexure of the flange portions and less force exerted against the adjoining floor coverings. This configuration is suitable, for example, for use over carpet, as well as over linoleum, tile and similar floor coverings.

FIG. 6B, in turn, shows an embodiment of the invention in which the cap strip 70 includes a cap portion 72 having a comparatively wide (e.g., approximately 13/32") first flange portion 74*a* which extends outwardly from the wall portion 16 at a first, comparatively shallow angle, and a second, narrower (e.g., 7/32") flange portion 74*b* which extends outwardly at a steeper downward angle. This contour is particularly suited for use in those installations in which the narrower flange extends over a surface of somewhat indeterminate height and/or against which the flange portion needs to exert a strong, downward pressure, such as certain types of laminate floor materials, for example.

FIG. 6C shows a moulding strip 80 in accordance with another embodiment of the present invention, in which the cap portion 82 has a first flange portion 84*a* which has a width and downward angle substantially similar to the flange portions 64*a*, 64*b* shown in FIG. 6A, and which is therefore suitable for use over carpet, linoleum, tile and similar floor coverings, and a wider (e.g., 11/16"), steeply down-angled second flange portion 84*b*. As can be seen, the width and downward angle of the wider flange portion 84*b* is such that it extends substantially the full height of the depending wall portion of the moulding, to a point about level with or slightly below the tip of the lowermost of the detachable rib portions 18*a-c*. This particular embodiment is especially suited to installations in which the height of the floor "steps down" from a carpet, linoleum, or other raised floor covering (over which the first flange portion 84*a* extends) to the level of an exposed subfloor (on which the base strip is mounted). The comparatively wide flange portion 84*b* is able to flex upwardly over a wide range of angles, depending on the height adjustment made by removing the rib portions, while still maintaining a firm, downward pressure which forms an effective seal against the lower floor surface.

The moulding of the present invention may be formed of any suitable material, with extrusion-molded PVC (polyvinyl chloride) and similar plastic materials being eminently suitable for this purpose. 80-90 durometer flexible PVC is particularly suited to the illustrated embodiments, and has adequate flexibility to follow most curved contours while still providing a stable and durable installation. The material may be provided in various colors that suitably match or complement the colors of the floor coverings with which the mouldings are to be used; moreover, the top surface of the cap portion may be provided with "woodgraining" or other decorative patterning, by printing, co-extension, adhesion or other suitable means.

It is to be recognized that various alterations, modifications, and/or additions may be introduced into the constructions and arrangements of parts described above without departing from the spirit or ambit of the present invention.

What is claimed is:

1. An adjustable height transition moulding that is mountable in a base track having an upwardly-opening channel portion, said transition moulding being formed of resiliently flexible material and comprising:

an elongate cap portion having first and second laterally extending flange portions for covering edges of floor coverings adjacent said base track;

a depending, substantially flat wall portion that extends downwardly from said cap portion generally beneath a junction between said first and second flange portions;

a downwardly-pointed non-detachable rib portion formed along a lower edge of said depending wall portion, said non-detachable rib portion comprising:

first and second outwardly extending, substantially horizontal upper surfaces on opposite sides of said wall portion; and first and second outwardly extending, upwardly-sloped lower wall surfaces on opposite sides of said wall portion, that meet said upper surfaces at first and second pointed edges of said non-detachable rib portion;

a depending, substantially flat web portion that extends downwardly from a lower edge of said non-detachable rib portion, said web portion being thinner than said wall portion and extending in generally vertical alignment therewith; and a plurality of downwardly-pointed detachable rib portions formed at vertically spaced locations on said web portion, said detachable rib portions each comprising:

first and second upwardly sloped upper surfaces extending outwardly on opposite sides of said web portion;

first and second upwardly sloped lower surfaces extending outwardly on opposite sides of said web portion; and first and second substantially flat outer edge surfaces extending generally vertically between said sloped upper and lower surfaces;

said sloped upper surfaces extending at shallower, generally more horizontal angles and said sloped lower surfaces extending at steeper, generally more vertical angles, so that said detachable rib portions taper from relatively thin and more flexible outer edges to relatively thicker and more rigid bases where said detachable rib portions are joined to said web portion;

said detachable rib portions being spaced apart vertically so as to form gaps intermediate said detachable rib portions in which vertical sides of said depending web portion are exposed, said gaps being sized sufficiently large to admit an edge of a blade therein so as to form a cut in one of said vertical sides of said web portion;

so that an installed height of said transition moulding is adjustable by inserting a blade into a selected one of said gaps intermediate said detachable rib portions so as to form a cut in said web portion rein and then extending said cut so as to remove one or more of said detachable rib portions that are located below said selected one of said gaps.

2. The adjustable height transition moulding of claim 1, wherein said first and second flange portions curve downwardly on said opposite sides of said wall portion by distances sufficient that said flange portions will contact said adjacent floor surfaces so as to be flexed upwardly thereby when said moulding is mounted in said base track.

3. The adjustable height transition moulding of claim 1, wherein said moulding is formed of a resiliently flexible material having a predetermined strength, and said web portion has a thickness selected relative to said predetermined strength to permit said web portion to be separated by manually forming a tear beginning at said cut.

4. The adjustable height transition moulding of claim 3, wherein said resiliently flexible material having a predetermined strength is extrusion moulded PVC having a durometer in the range in a range from about 80 to 90, and wherein said web portion has a thickness of about 1/16".

* * * * *